US006237809B1

(12) United States Patent
Kawai et al.

(10) Patent No.: US 6,237,809 B1
(45) Date of Patent: May 29, 2001

(54) CONTAINER FOR HIGH PURITY LIQUID CHEMICALS

(75) Inventors: Keiji Kawai, Toyokawa; Yoshiaki Ito, Toyohashi; Yasuyuki Nakamura, Toyokawa, all of (JP)

(73) Assignee: Aicello Chemical Co., Ltd. (JP)

( * ) Notice: Subject to any disclaimer, the term of this patent is extended or adjusted under 35 U.S.C. 154(b) by 0 days.

(21) Appl. No.: 09/429,629

(22) Filed: Oct. 29, 1999

(51) Int. Cl.[7] ..... B67D 5/02
(52) U.S. Cl. ..... 222/95; 222/105; 222/400.7
(58) Field of Search ..... 222/95, 96, 105, 222/107, 400.7

(56) References Cited

U.S. PATENT DOCUMENTS

| | | | | |
|---|---|---|---|---|
| 5,031,801 | | 7/1991 | Osgar et al. | 222/153 |
| 5,102,010 | | 4/1992 | Osgar et al. . | |
| 5,335,821 | | 8/1994 | Osgar | 222/83 |
| 5,435,460 | | 7/1995 | Osgar | 222/83 |
| 5,435,462 | | 7/1995 | Fujii . | |
| 5,526,956 | | 6/1996 | Osgar | 222/83 |
| 5,799,830 | * | 9/1998 | Carroll et al. | 222/95 |
| 5,875,921 | | 3/1999 | Osgar et al. | 222/82 |
| 5,957,328 | | 9/1999 | Osgar et al. | 222/95 |

FOREIGN PATENT DOCUMENTS

| | | |
|---|---|---|
| 91 10 742 | 1/1992 | (DE) . |
| 195 07 211 | 9/1996 | (DE) . |
| 197 27 294 | 1/1999 | (DE) . |
| 0 111 119 | 6/1984 | (EP) . |
| 0 389 191 | 9/1990 | (EP) . |
| 10-045961 | 2/1998 | (JP) . |
| WO 89/07575 | 8/1989 | (WO) . |

* cited by examiner

*Primary Examiner*—J. Casimer Jacyna
(74) *Attorney, Agent, or Firm*—Parkhurst & Wendel, L.L.P

(57) ABSTRACT

A container does not cause any quality deterioration of high purity chemicals included therein during the storage and transportation thereof and is not easily broken. The container also permits easy and safe discharge of the high purity chemical. The container for a high purity chemical comprises a flexible internal container formed from a polyolefinic high purity resin and a gas-tight, self-supporting external container, which accommodates the internal container, wherein these internal and external containers are joined together in such a manner that the space formed between these two containers are arbitrary closed and opened so as to ensure the communication with the outside, a liquid-discharge pipe provided with a check valve connected to the pipe midway therein is gas-tightly inserted into the internal container down to the bottom thereof and a connector connected to a pressure source is fitted to the external container.

7 Claims, 4 Drawing Sheets

CONTAINER FOR HIGH PURITY LIQUID CHEMICALS

BACKGROUND OF THE INVENTION

The present invention relates to a container used for the storage or discharge of a high purity liquid chemical, which is employed in the fields of semiconductors and liquid crystals.

The rule for designing, for instance, integrated circuits have increasingly required a high degree of miniaturization thereof because of the recent rapid progress in the electronic devices. High purity liquid chemicals such as liquid photoresists used for such fine patterning techniques should not give rise to any quality deterioration, during the storage and transportation thereof, such as an increase in the amount of impure fine particles in such a liquid chemical, degeneration of components thereof, quantitative changes in the composition, an increase in the quantity of impure metal elements present therein or deterioration of light-sensitive components due to irradiation of the chemical with light rays. The increase in the quantity of impure fine particles in such a liquid photoresist and the degeneration of the components thereof are mainly caused by dissolution of some components present in the container material into the liquid photoresist. If a photoresist film is formed by applying such a contaminated liquid photoresist onto the surface of a substrate, pinholes would be formed thereon. In addition, the quantitative changes in the composition of the liquid are resulted from the permeation of an organic solvent present in the liquid into the exterior through the wall of the container. The liquid accordingly entrains a change in its viscosity and the thickness of the resulting photoresist film is correspondingly changed. The quality deterioration of these liquid photoresists has serious adverse effects on the quality of the resulting semiconductors and liquid crystal displays and yields thereof and would, in turn, shorten the lifetime of the liquid per se.

It has been known that the term "cleanness" is used as an indication for estimating the extent of the quality deterioration of a liquid photoresist in container due to any release of impure fine particles from the container into the liquid during the storage thereof over a long period of time. The cleanness is evaluated by storing ultra high pure water or a liquid photoresist in a container to be tested for a predetermined period of time and then determining the number of fine particles, whose particle size is not less than 0.2 $\mu$m, included in 1 ml of the liquid stored in the container. More specifically, the cleanness can be defined by the following equation:

$$\text{Cleanness (particles/ml)}=[c(\text{particles})\times a/2(\text{ml})]/[b(\text{ml})\times a(\text{ml})] \quad (1)$$

In the equation (1), a represents the volume of the container, and b represents the quantity of the liquid content taken from the container to be tested. First, the sample liquid for determining the initial cleanness of the liquid is taken from the container according to the following method. To a test container having a volume of a (ml), there is added ultra pure water or a liquid photoresist in an amount of a half of the volume, a/2 (ml), of the container, followed by shaking it for 15 seconds, allowing it to stand over 24 hours and then collection of a sample liquid. On the other hand, the sample liquid used for the evaluation of the cleanness after the storage of the water or the liquid photoresist is taken from the container by the following method: That is, the container used for the determination of the initial cleanness is tightly sealed with a plug, then allowed to stand for a predetermined time period and then rotated over three turns while paying an attention so as not to form any air bubble, followed by the collection of a sample liquid. In the equation (1), c represents the number of fine particles, as determined using a particle counter, which are present in the whole liquid sample and have a particle size of not less than 0.2 $\mu$m. Accordingly, the initial cleanness and that determined after the storage over a predetermined period of time can be calculated on the basis of the number of fine particles thus determined. In this regard, the lower the numerical value indicating the cleanness, the higher the quality of the liquid photoresist. More specifically, if the cleanness is less than 100 particles/ml, such a liquid chemical can stably be stored without causing any quality deterioration of semiconductors and liquid crystal displays (LCD) and any reduction of the yield thereof.

As containers for storing liquid photoresists and related liquid chemicals, there have usually been used, for instance, glass containers and metal containers. However, the glass and metal containers cannot ensure a high cleanness of the contents thereof. This is because sodium ions are released from the glass container and each metal container releases ions of the corresponding metal element constituting the container such as iron ions. In this respect, Japanese Patent Application Publication No. Hei 6-99000 proposes a method for eliminating these adverse effects, which comprises using a container consisting of a pouch made from an inert and corrosion-resistant plastic film (polytetrafluoroethylene film) and an external bottle or an overpack which surrounds the pouch and discharging a liquid chemical accommodated in the pouch using a dispenser.

However, such a polytetrafluoroethylene pouch cannot ensure an acceptable level of the cleanness. This method also suffers from a problem in that the pouch is disposable, but it is difficult to dispose the same after the practical use thereof. Moreover, polytetrafluoroethylene is very expensive.

SUMMARY OF THE INVENTION

The present invention has been developed for eliminating the foregoing drawbacks associated with the conventional containers for storing and discharging high purity liquid chemicals and thus, it is an object of the present invention to provide a container, which never deteriorates the quality of high purity liquid chemicals such as liquid photoresists during the storage and transportation thereof and which is hardly broken. It is another object of the present invention to provide a container, which permits stable and easy discharge of a high purity liquid chemical.

The following is the description of the present invention developed for accomplishing the objects described above. The present invention will be described below in detail with reference to the accompanying drawings, which correspond to specific embodiments of the present invention.

As will be seen from FIG. 1, the container for a high purity chemical according to the present invention comprises a flexible internal container 2 formed from a polyolefinic high purity resin and a gas-tight, self-supporting external container 3, which accommodates the internal container 2, wherein these internal and external containers are joined together in such a manner that the space formed between these two containers are arbitrary closed and opened so as to ensure the communication with the outside, a liquid-discharge pipe 16 provided with a check valve 19 connected to the pipe midway therein is gas-tightly inserted into the internal container down to the bottom thereof and a connector 12 connected to a pressure source 11 is fitted to the external container 3.

It is preferred in the container for high purity chemicals, as shown in FIG. 3, that an airtightness-maintaining tool 17, which holds the liquid-discharge pipe 16 at an opening 20 of the internal container is engaged with an opening 21 of the external container through screwing and the screwing member may be closed and opened so that the interior of the external container is arbitrary communicated with the outside.

Alternatively, the container for high purity chemicals may comprise, as shown in FIGS. 3 and 4, the liquid-discharge pipe 16, which is divided into an upper portion 16A provided with the check valve 19 midway therein and a lower portion 16B inserted into the internal container 2, and a cover 31 for opening and closing, which is engaged with the opening 21 of the external container through screwing and can be opened and closed so that the interior of the internal and external containers 2 and 3 are communicated with the outside, exchangeably with the action of the airtightness-maintaining tool 17 simply supporting the upper portion 16A.

It is also preferred that the liquid-discharge pipe 16 and the airtightness-maintaining tool 17 and/or the cover 31 for opening and closing are formed from polyolefinic high purity resins similar to that used for preparing the internal container 2. Thus, the release of fine particles and metal ions from the resulting container can be suppressed even if it comes into contact with a high purity chemical 4.

Examples of such polyolefinic high purity resins usable herein are polymers of olefins such as ethylene, propylene, butene-1, 4-methyl-pentene-1, hexene-1 or octene-1; copolymers of ethylene with olefins other than ethylene; or any blend of these polymers.

The content of α-olefin repeating units present in the copolymer is not more than 15% by weight and the copolymer may have an atactic, isotactic or syndiotactic molecular structure. The method for polymerization preferably used herein is a low pressure or moderate pressure method.

DETAILED EXPLANATION OF THE INVENTION

Embodiments of the container for high purity chemicals according to the present invention will hereunder be described in more detail with reference to the accompanying drawings.

Figure 1:
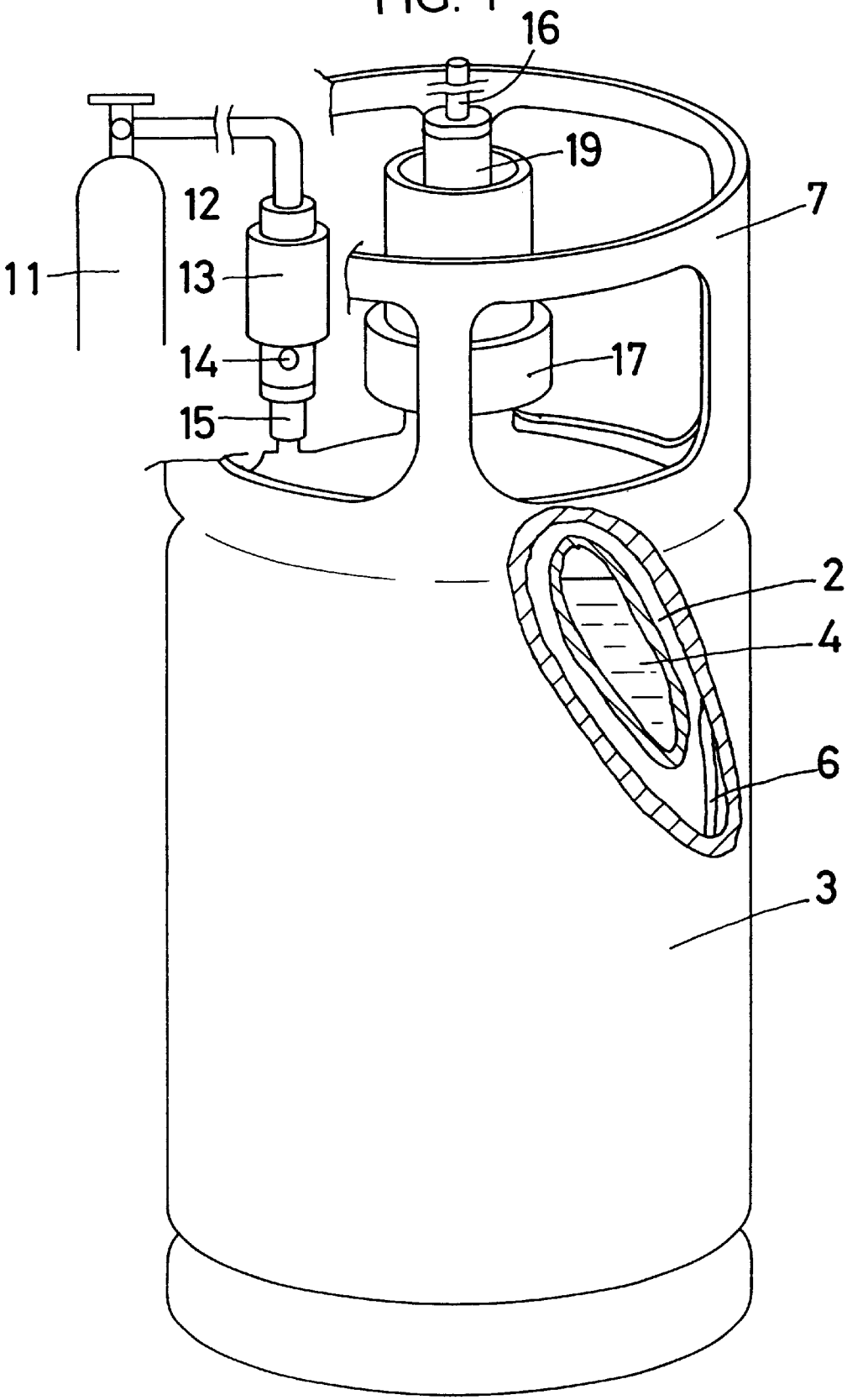
FIG. 1 is a general view of an embodiment of the container for high purity chemicals according to the present invention.
Figure 2:
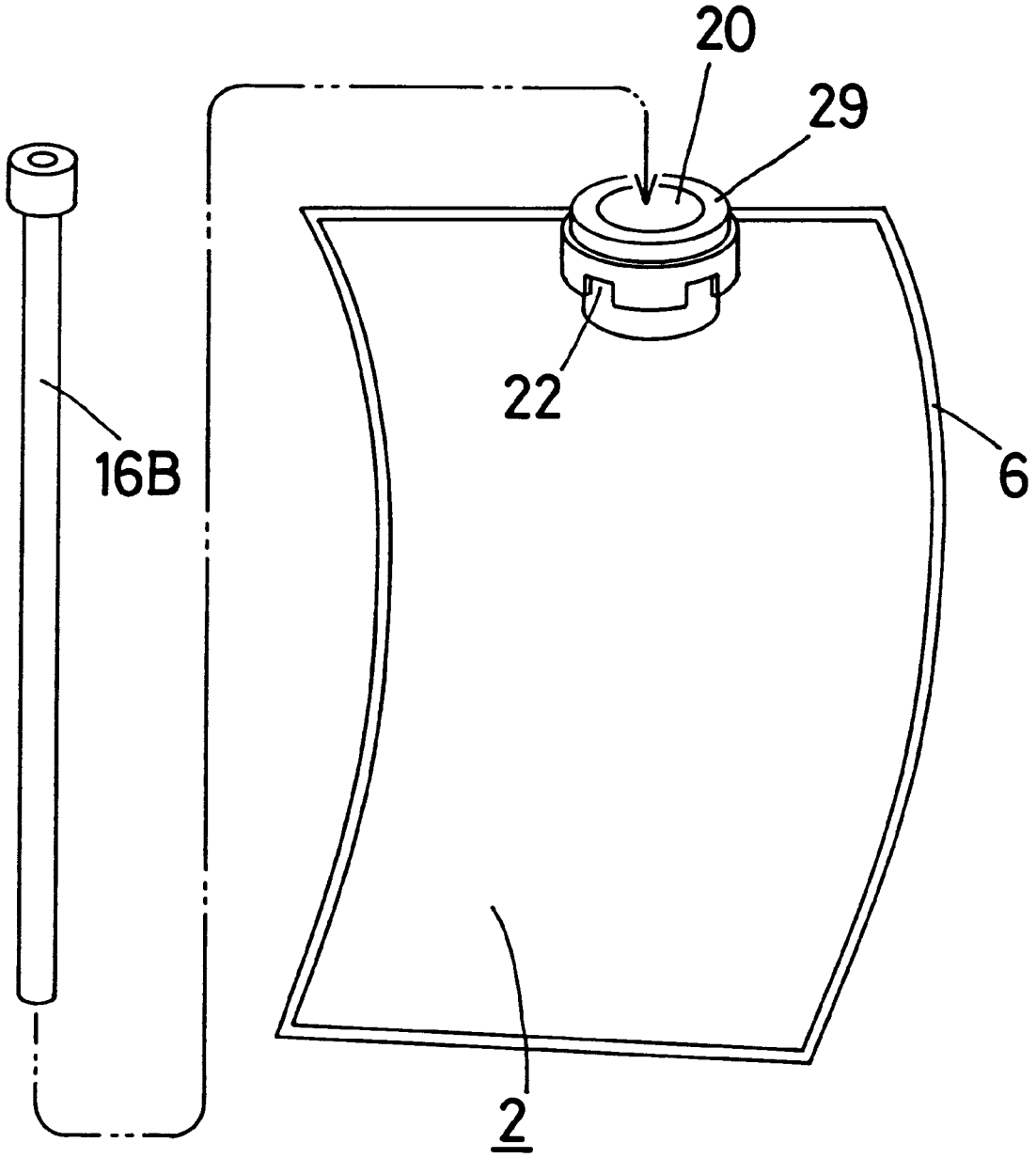
FIG. 2 is a schematic diagram showing an internal container of the container for high purity chemicals.

The general appearance of the container for high purity chemicals is shown in FIG. 1 and the container comprises a flexible internal container 2 and an airtight, self-supporting external container 3, which accommodates the internal container 2.

The internal container 2 consists of a polyolefinic high purity resin film or a bag, which consists of resin films, put in layers, having fusion-bonded portion 6 at the periphery thereof, and thus the container is collapsible and can be smashed when it is not used.

The content of polymers having a weight-average molecular weight, as determined by the gel permeation chromatography (GPC) technique is not more than $1\times10^3$, present in the polyolefinic high purity resin is less than 5% by weight. The container formed from a resin having such a polymer content of not less than 5% by weight would easily release impure fine particles into a high purity chemical accommodated therein. Thus, the use of such a container is not preferred as a container for storing and transporting high purity chemicals since the cleanness thereof is not less than 100 particles/ml.

The molecular weight of, for instance, resins is determined by the method in which resin pellets are dissolved in a solvent (such as o-dichlorobenzene) to give a sample solution and then the molecular weight and molecular weight distribution thereof are determined by the GPC technique. The weight-average and number-average molecular weights are estimated according to the following relations, respectively:

$$\text{Weight-average Molecular Weight}=\Sigma(M\times w)/\Sigma w \quad (2)$$

$$\text{Number-average Molecular Weight}=\Sigma w/\Sigma(M\times w) \quad (3)$$

In these relations, M represents the molecular weight of a polymer component and w means the weight fraction thereof. The conditions for the GPC measurement are as follows: GPC apparatus used: 150 CV (available from Waters Company); column used: TSKgel GMH-HT (available from Tosoh Corporation); solvent used: o-dichlorobenzene; temperature: 138° C.; and detector used: differential refractometer.

When obtaining a polyolefinic high purity resin by polymerizing the foregoing raw material, a catalyst may, if necessary, be used in a desired amount. At this stage, a neutralizer, an antioxidant and a light stabilizer are also added according to need, but they would be the source of impure fine particles since they may be released from the resulting internal container 2 into the high purity chemical 4 contained therein if they are used in large amounts.

It is not necessary to use any neutralizer when the polymerization is carried out by the moderate pressure method, while the neutralizer serves as a chlorine atom-scavenger in case of the low-pressure polymerization method. Examples of such neutralizers usable herein are stearates of alkaline earth metals such as calcium, magnesium and barium, but the amount thereof to be used should be restricted to the lowest possible level by, for instance, improving the activity of the catalyst used in the polymerization step. If the content of the neutralizer exceeds 0.01% by weight on the basis of the total weight of the resin composition, the resulting container has a cleanness of higher than 100 particles/ml and this in turn deteriorates the quality of semiconductors and LCD's and impairs the yield thereof. For this reason, the content of the neutralizer should be controlled to a level of not more than 0.01% by weight based on the total weight of the resin composition.

Examples of antioxidants usable herein are phenolic antioxidants such as butyl hydroxytoluene, pentaerythtyl-tetrakis [3- (3,5-di-t-butyl-4-hydroxyphenyl) pro pionate] and octadecyl-3-(3,5-di-t-butyl-4-hydroxy-phenyl) propionate. The content of the antioxidant should be limited to a level of not more than 0.01% by weight based on the weight of the resin composition for the same reason as set forth above in connection with the neutralizer.

In addition, examples of light stabilizers usable herein are benzotriazole type light stabilizers such as 2-(5-methyl-2-hydroxyphenyl) benzotriazole and 2-(3-t-butyl-5-methyl-2-hydroxyphenyl)-5-chlorobenzotriazole; and hindered amine type light stabilizers such as bis(2,2,6,6-tetramethyl-4-piperidine) sebacate and poly[[6-( 1,1,3,3-tetramethylbutyl) amino- 1,3,5-triazin-2,4-diyl] [2,2,6,6-tetramethyl-4-piperidyl] imino] hexamethylene [(2,2,6,6-tetramethyl-4-piperidyl) imino]]. The content of the light stabilizer should be limited to a level of not more than 0.01% by weight based on the weight of the resin composition for the same reason as set forth above in connection with the neutralizer.

Materials for preparing the internal container 2 preferably possess barrier properties against ketones such as methyl ethyl ketone, esters such as ethyl lactate, lactones such as γ-butyrolactone and cellosolves such as ethyl cellosolve acetate, which are included in liquid photoresists.

The container for high purity chemicals according to the present invention can be used for storing liquid photoresists and dilution solvents, which are used in the semiconductor production processes and liquid crystal displays as well as other high purity chemicals. Examples of photoresists for semiconductor-production processes are positive photoresists each comprising, as essential components, an alkali-soluble resin such as cresol-formaldehyde novolak resin or poly(vinylphenol) and a quinone diazide type light-sensitive agent such as benzoquinone diazide sulfonate, naphthoquinone diazide sulfonate, benzoquinone diazide sulfonamide and naphthoquinone diazide sulfonamide. As color resists for liquid crystal displays, there can be mentioned, for instance, those each comprising a photopolymer, which consists of an acrylate monomer, a trihalomethyl triazine type photopolymerization initiator and an acrylic acid/acrylate copolymer, and an organic pigment dispersed in the photopolymer.

A photoresist of this type includes a component sensitive to light rays having a wavelength ranging from 200 to 500 nm and therefore, the external container 3 must have light-shielding properties. Moreover, the external container 3 is not directly brought into contact with the liquid chemical and accordingly, the material for the external container is not limited to any specific one inasmuch as they can withstand the pressure required for pressure-feeding a medium for discharging the liquid chemical contained in the container, which is at highest 3.0 kg/cm$^2$. Examples of materials for producing the external container 3 preferably include metallic materials such as stainless steel; and plastic materials such as polycarbonate, polyethylene and polypropylene.

The resin film constituting the internal container 2 can be obtained by molding a raw material into a cylindrical shape while blowing clean air filtered through a filter according to the inflation method. A hole is formed through the cylindrical film and a tube holder 29 is inserted into the hole and fusion-bonded through heat-sealing. Then the cylindrical film thus processed is inserted into an unprocessed cylindrical film and all sides of the assembly are heat-sealed to give an internal container 2. Thus, the internal container 2 is formed from a double layered film. Alternatively, if the exterior of the internal container 2 is surrounded by a film having a multi-layered structure and prepared from various materials arbitrary selected from metallic materials such as aluminum, and plastic materials such as polyamide, polyvinyl alcohol and poly(ethylene-co-vinyl alcohol), a variety of properties such as light-shielding and solvent-barrier properties as well as safety to leakage can be imparted to the resulting internal container 2. The tube holder 29 fitted to the internal container 2 has an opening 20 and a notch 22.

Figure 3:
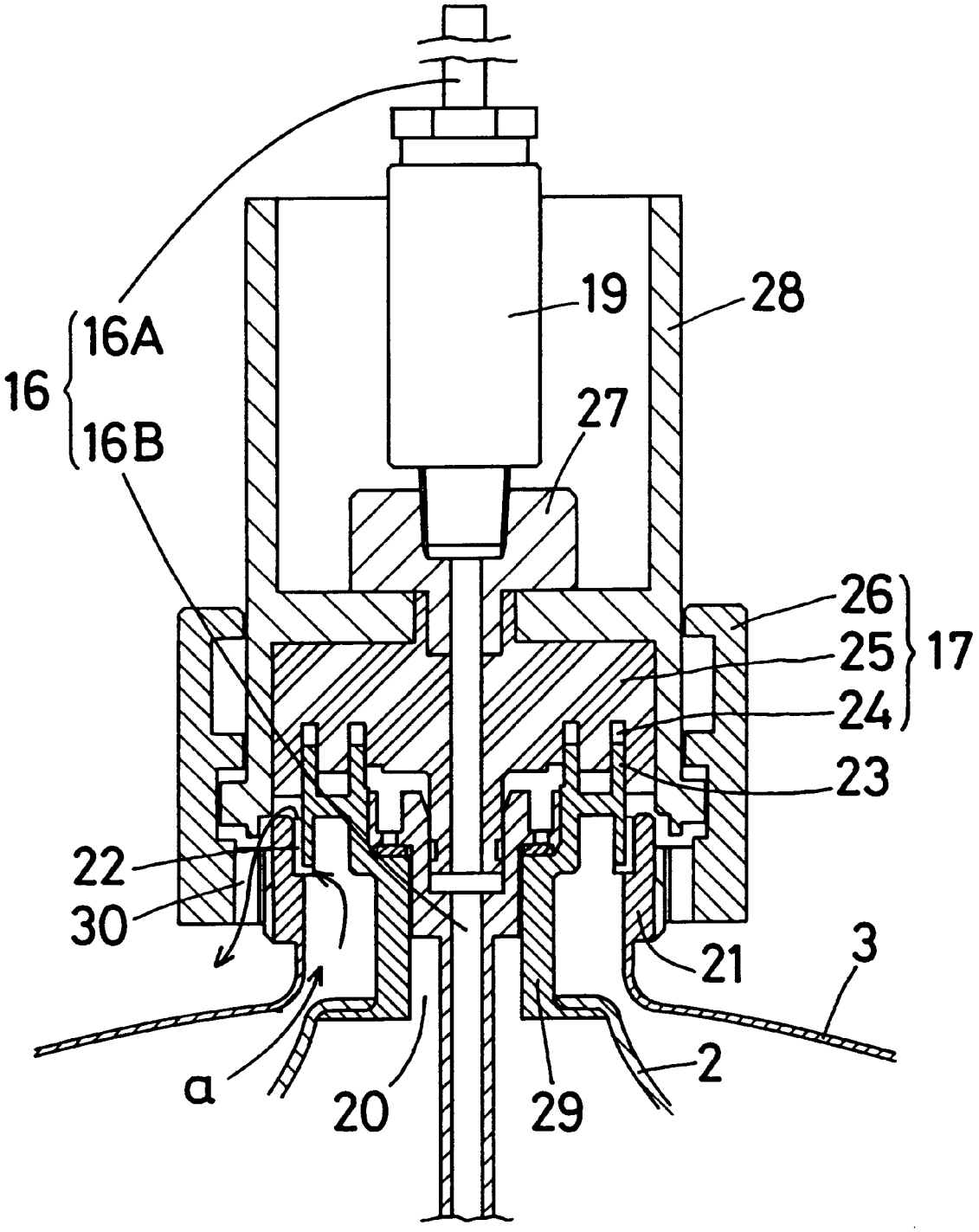
FIG. 3 is a schematic diagram showing the essential parts of the container for high purity chemicals.

As will be seen from FIG. 3, a liquid-discharge pipe 16 is inserted into the internal container 2 down to the bottom thereof and one end of the pipe is guided to the exterior of the container 2. The liquid-discharge pipe 16 comprises an upper portion 16A connected to a check valve 19 midway therein and a lower portion 16B, passes through an inside plug 25 at the middle part thereof and is communicated with the internal container 2 in a sealed condition. The lower portion 16B is air-tightly inserted into the opening 20 of the internal container 2, while the upper portion 16A is fixed to a holder 28 by a fixing tool 27 through the check valve 19 positioned in the middle thereof. An appropriate number of vent holes 36 are arranged at the upper tip of the liquid-discharge pipe 16B.

An airtightness-maintaining tool 17 is engaged, through screwing, with the external container 3 at the opening 21 of the latter and thus the internal container 2 is airtightly sealed therein. The airtightness-maintaining tool 17 consists of an inside plug 25 provided with a key seat 24 and a box nut 26. A convex key seat 23 on the side of the tube holder 29 is engaged with the concave key seat 24 and the box nut 26 is screwed in the opening 21 of the external container 3. The box nut 26 is provided with a vent hole 30 through which the space formed between the internal and external containers 2 and 3 are opened to the outside when the box nut is loosened.

Moreover, a pressure source 11 as an inert gas bomb is connected to the external container 3. A connector 12 communicated to the pressure source 11 through a pressure hose has a vent hole 14 for releasing the residual pressure within the external container 3 and a connector cover 13 for closing the vent hole 14 and is connected to a plug 15 which is communicated with the interior of the external container 3. In addition, a handle 7 is fitted to the external container 3.

A screwed-in cover 31 is provided for the external container 3, which is used in place of the airtightness-maintaining tool 17. The cover 31 is provided with an appropriate number of vent holes 35 and packings 32, 33, 34.

The procedures for practically using the container for high purity liquid chemicals will be described in detail below.

The internal container 2, in which the lower portion 16B of the liquid-discharge pipe is inserted, is folded compact, inserted in the external container 3 and the tube holder 29 of the internal container 2 is put in the opening 21 of the external container 3. A high purity liquid chemical is injected into the internal container 2 in such a condition through a nozzle (not shown) for introducing the liquid chemical and the lower portion 16B of the liquid-discharge pipe. Once the internal container 2 is inflated while remaining an appropriate space between the internal and external containers 2 and 3, the injection of the liquid is interrupted and the cover 31 is screwed in the opening 21 of the external container 3 to thus airtightly seal the internal container 2 and the lower portion 16B of the liquid-discharge pipe. The liquid chemical is stored and transported in this state.

Figure 4:
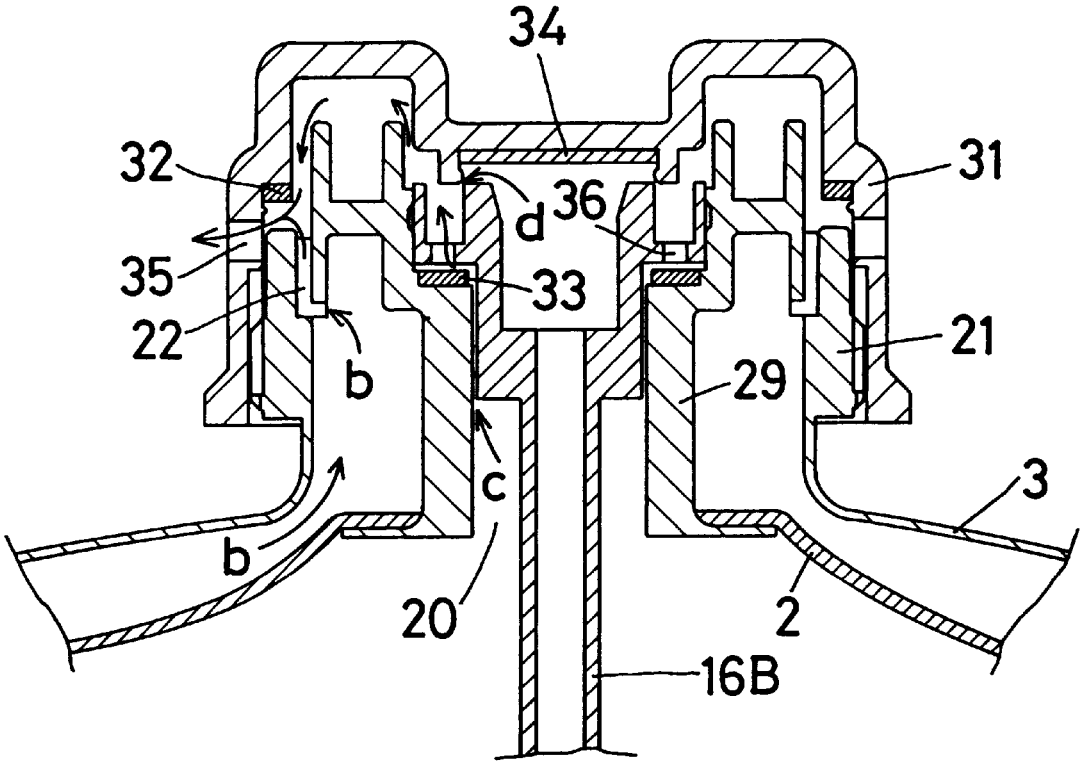
FIG. 4 is a cross sectional view showing a cover for opening and closing, secured to the container for high purity chemicals.

The high purity liquid chemical is evaporated due to, for instance, an increase of the temperature and vibrations during storage and/or transportation and this results in an increase in the internal pressure of the container for high purity liquid chemical. If the cover 31 is loosened at this stage, the pressure in the external container 3 is released to the outside through the space between the notch 22, the packing 32 and the external container 3 and the vent hole 35, as indicated by an arrow b in FIG. 4. The pressure in the internal container 2 is released to the outside through the space between the packing 33 and the liquid-discharge pipe 16B, the vent hole 36, the space between the packing 32 and the external container 3 and vent hole 35, as indicated by an arrow c in FIG. 4. The inner pressure of the lower portion 16B of the liquid-discharge pipe is released to the outside through the packing 34, the space between the packing 32 and the external container 3 and vent hole 35, as indicated by an arrow d in FIG. 4. Such operations permits the release of the residual pressure and safe removal of the cover 31 without causing any blowing off of the high purity liquid chemical 4 and/or the prevention of the cover 31 from being blown off.

When discharging the high purity liquid chemical from the container therefor, the cover 31 is loosened to remove the same, the airtightness-maintaining tool 17 is secured to the opening 21 of the external container and the upper portion 16A of the liquid-discharge pipe is joined to the lower portion 16B of the pipe. The convex key seat 23 is engaged with the concave key seat 24, while the box nut 26 is tightened against the opening 21 of the external container to thus tightly close the internal and external containers. Then the connector 12 communicated to the compressed air bomb 11 is joined to the plug 15 and the vent hole 14 is closed by the connector cover 13. If the regulator of the compressed air bomb 11 is opened to send air, the compressed air is introduced into the space between the internal and external containers 2 and 3 and thus the high purity liquid chemical 4 is discharged through the check valve 19 and the liquid-discharge pipe 16 by the action of the compressed air. After the interruption of the compressed air supply, the connector cover 13 is pulled up. Thus, the vent hole 14 is exposed and the residual pressure in the space between the internal and external containers 2 and 3 is released.

Alternatively, if the box nut 26 is loosened in place of the foregoing operations, the residual pressure is likewise automatically released through the notch 22, the space between the external container 3 and the inside plug 25 and the vent hole 30, as indicated by an arrow a (see FIG. 3). At the same time, the residual pressure in the internal container 2 and the liquid-discharge pipe 16 are also released. For this reason, the high purity liquid chemical 4 never causes any blowing off and the members fitted to the openings of the external and internal containers 3 and 2 are not blown off at all.

Since the high purity liquid chemical 4 contained in the internal container 2 does not come in direct contact with the gas supplied from the pressure source 11, as has been described above, the liquid chemical never causes any quality deterioration due to the dissolution of the gas in the liquid chemical and accordingly, the gas is not necessarily an inert gas.

The present invention will hereunder be described with reference to the following Examples 1 and 2 which relate to the containers for high purity liquid chemicals according to the present invention and Comparative Examples 1 and 2 which are beyond the scope of the present invention.

Example 1

As the raw resin for preparing the internal container 2, there was used high density polyethylene pellets comprising 2.57% by weight of a polymer having a density of 0.935g/$cm^3$, a melt index of 0.20 g/10min. and a weight-average molecular weight of not more than $1\times10^3$ and which is free of any neutralizer, antioxidant and light stabilizer. Using an inflation molding machine, the resin was molten in an extruder (screw diameter: 50 m/m; L/D=26 (D: screw diameter and L: effective length of screw)) at 200° C., extruded through a circular die (die diameter: 50 m/m, die gap: 2.0 m/m), molded at a blow-up ratio of 3.5 to thus give a cylindrical film having a thickness of 60 $\mu$m and a folded diameter of 280 mm. Two cylindrical films were put on top of each other, cut into a piece having a desired length, followed by forming a hole at a desired site of the one film, passing a tube holder 29 provided with an opening 20 for the internal container through the hole and fusion-bonding them through heat sealing. Thereafter, the both films were put on top of each other and all sides of the assembly were heat-sealed to give an internal container A as a trial container.

First of all, the internal container A as a trial product was inspected for the cleanness. More specifically, the container A was accommodated in a stainless steel external container (inner volume: 4 liters). To the container A, there was added 2 liters of ultra pure water prepared using an ultra pure water-producing device (available from Toray Industries, Inc. under the trade name of TORAYPURE LV-lOT), then the container was tightly closed with a screw cap, followed by shaking it for 15 seconds, allowing to stand over 24 hours, collection of 5 ml of a sample and determination of the number of fine particles having a particle size of not less than 0.2 $\mu$m, released from the container to the ultra pure water using a particle counter (Type: KL-22 available from Lyon K. K.). The number (particles/ml) of fine particles present in the water was calculated using the following formula (4) similar to the formula (1) and the result was defined to be the cleanness of the container with respect to ultra pure water. The results thus obtained are summarized in the following Table 1.

Number of Fine Particles in Water (particles/ml)=[Counts (particles)×Amt. Of Ultra Pure Water (2000ml)]/[Amt. Of Sample (5ml)×Container Volume (4000ml)] (4)

The data listed in Table 1 indicate that the initial cleanness is 12 particles/ml and this indicates that the number of impure fine particles released from the container is quite low.

TABLE 1

| Items Tested | | Cleanness (particles/ml) Water* | Resist A | | Rate of Wt. Loss (%) EGA | |
|---|---|---|---|---|---|---|
| Liquid Content Conditions for storage | | Initial | Initial | 1 Month | 23° C., 6 months | 40° C., 3 months |
| Ex. 1 | Internal Container A | 12 | 15 | 24 | <0.01 | <0.01 |
| Ex. 2 | Internal Container B | 15 | 13 | 25 | <0.01 | <0.01 |
| Comp. Ex. 1 | Inner Bag C of PTFE | 110 | 265 | 358 | <0.01 | <0.01 |
| | Inner Bag D of LDPE | 2575 | 2656 | 3290 | 0.01 | 0.02 |
| Comp. Ex. 2 | Metal Container | 273 | 656 | 863 | <0.01 | <0.01 |
| | Glass Bottle | 1797 | 341 | 506 | <0.01 | <0.01 |

*Ultra Pure Water

Then to each container, there was added 2 liter of a positive photoresist (Resist A) comprising a solid content which consisted of a cresol-formaldehyde novolak resin and a naphthoquinone diazide sulfonate type light-sensitive agent, and ethyl cellosolve acetate as a solvent and the cleanness was determined according to the following formula (5) like the foregoing procedures used above. The results thus obtained are likewise listed in Table 1.

No. of Fine Particles in Resist (particles/ml)=[Counts (particles)×Amt. Of Resist (2000ml)]/[Amt. of Sample (5ml)×Container Volume (4000ml)] (5)

Moreover, the container was again tightly closed with a cap and then allowed to stand for one month at ordinary temperature. After the elapse of one month, the container was rotated 3 turns without generating any air bubble to thus shake the liquid photoresist in the container, followed by collection of 5 ml of a sample. The same procedures used above were repeated to determine the number (particles/ml) of fine particles present in the liquid photoresist, which was defined to be the cleanness after one month. The results obtained are also listed in Table 1.

As will be seen from the data listed in Table 1, the initial cleanness of the container A with respect to the resist A was found to be 15 particles/ml and that observed after one month was found to be 24 particles/ml. This clearly indicates that the container A released only a quite small number of impure fine particles into the resist A.

Then 4 liters of ethyl cellosolve acetate (EGA) were introduced into each container, the container was tightly closed with a cap and stored at 23° C. and 40° C. in a thermostatic chamber to determine the weight loss (%) of the EGA with time. The results thus obtained are listed in Table 1.

The data listed in Table 1 clearly indicate that the container exhibited quite low weight loss and more specifically, the weight losses were found to be not more than 0.01% after the storage at 23° C. for 6 months and not more than 0.01% after the storage at 40° C. for three month.

Moreover, 4 liters of ethyl cellosolve acetate (EGA) were introduced into each container, which was tightly closed with a cap and stored at 23° C. in a thermostatic chamber to determine the metal ion concentration in the EGA after the 6 months' storage using ICP-MS (HP-4500: available from Yokokawa Analytical Systems Co., Ltd.). The results thus obtained are listed in the following Table 2.

TABLE 2

| Metal Ion Species | | Metal Ion Concentration (ppb) | | | | | | | |
|---|---|---|---|---|---|---|---|---|---|
| | | Na | K | Ca | Mg | Fe | Al | Ni | Cr |
| Ex. 1 | Internal Container A | <0.1 | <0.1 | <0.1 | <0.0 | <0.1 | <0.1 | <0.1 | <0.1 |
| Ex. 2 | Internal Container B | <0.1 | <0.1 | <0.1 | <0.1 | <0.1 | <0.1 | <0.1 | <0.1 |
| Comp. | Inner Bag C of PTFE | <0.1 | <0.1 | 0.1 | <0.1 | 0.3 | <0.1 | <0.1 | <0.1 |
| Ex. 1 | Inner Bag D of LDPE | <0.1 | <0.1 | 0.1 | <0.1 | 0.7 | 0.1 | <0.1 | <0.1 |
| Comp. | Metal Container | <0.1 | <0.1 | <0.0 | <0.1 | 0.3 | <0.1 | 0.2 | <0.1 |
| Ex. 2 | Glass Bottle | 13 | <0.1 | <0.1 | <0.1 | 0.2 | <0.1 | 0.1 | <0.1 |

As will be seen from the data listed in Table 2, there was not observed any increase in the metal ion concentration in the resist at all, even after the storage thereof at 23° C. for 6 months.

The liquid photoresist, which had been stored in a container for high purity liquid chemical having the structure as shown in FIG. 1, at 23° C. for one week was communicated to a coating machine through an intermediate tank and was applied onto a silicon wafer using a spin coater, followed by inspection of the resulting resist film for the thickness and coating properties (such as the presence of pinholes and striation) in order to examine the influence of the permeation of the organic solvent from the resist through the container on the coating properties of the resist. The results thus obtained are summarized in the following Table 3:

TABLE 3

| Resist | Storage Time | Thickness (μm) | Coating Properties | Overall Evaluation of Coating Properties |
|---|---|---|---|---|
| Resist A | 0 hr. | 1.001 | good | Good |
| | 1 week | 1.002 | good | Good |
| Resist B | 0 hr. | 1.002 | good | Good |
| | 1 week | 1.003 | good | Good |

The film thickness herein means the thickness of a photoresist film prepared by applying a resist liquid onto the surface of a silicon wafer using a spin coater (4000 rpm) and then pre-baking the resist layer at 90° C. for one minute and the allowed variation thereof should fall within the range of ±0.5% of the initial value. In Table 3, the term "good" appearing in the column entitled "Coating Properties" means that any pinhole is not formed and any striation is not observed at all. In addition, the term "good" appearing in the column entitled "Overall Evaluation of Coating Properties" means that the variation in the thickness of the resist film falls within the range of ±0.5% of the initial value and that the coating properties of the resist are excellent.

Finally, the resist liquid A was inspected for other characteristic properties. Resists A, one of which was immediately after the production and the other was after the storage for 3 months, were washed according to the usual method and applied onto a surface of a silicon wafer under the predetermined conditions using a spin coater. The applied resist layers were baked for one minute on a hot plate maintained at 90° C. Then the resist layers were exposed to light using a stepper for I-rays. The resulting wafer was baked on a hot plate maintained at 110° C. for one minute. These wafers were developed with an alkali developer (a 2.38% aqueous solution of tetramethyl ammonium hydroxide) to give a positive pattern. Each of the resulting positive patterns was inspected for various properties such as the resolution, the effective sensitivity, the rate of remaining film, the presence of scum (developing residues) and the adhesion thereof to the silicon wafer. The results thus obtained are summarized in the following Table 4.

As has been shown in Tables 3 and 4, the resist liquid after the storage over a long period of time does not undergo any quality deterioration, since there was not observed any significant change in the coating properties, resolution, sensitivity, rate of remaining film, presence of scum and adhesion to silicone wafers.

Example 2

The same procedures used in Example 1 were repeated except for the following to give an internal container B. In other words, a double layered bag was used, which was formed by covering the outside of an inner layer comprising a film of the high density polyethylene used in Example 1 with a commercially available polyamide multilayered film (comprising nylon-6,6 layer/adhesive layer/low density polyethylene layer=20/10/30 (μm), from the outside). The resulting internal container B was accommodated in a hard external container (inner volume: 4 liter) of polyethylene produced by blow molding.

The cleanness, rate of weight changes (%) and metal ion concentration were determined by the same methods used in Example 1. The results obtained are listed in the foregoing Tables 1 and 2.

As has been shown in Table 1, the number of impure fine particles released from the container to the content thereof was very small and more specifically, the container B exhibited a cleanness of 15 particles/ml for water, 13 particles/ml for the resist B and 25 particles/ml for the resist after the storage over one month.

Moreover, the weight loss observed was found to be very low and more specifically, it was found to be not more than 0.01% when the container was stored at 23° C. for 6 months and not more than 0.01 % when the container was stored at 40° C. for 3 months.

In addition, any increase in the metal ion concentration was not observed at all even after the storage of the resist at 23° C. for 6 months, as will be seen from the data listed in Table 2.

Then it was found that the container showed extremely excellent light-shielding properties. More specifically, a specimen having a size of 1×4 cm square was cut out from the trunk part of the hard polyethylene external container and the absorbance thereof at wavelengths ranging from 900 to 200 nm was determined using a spectrophotometer (Type: Ubest-55 available from Nippon Bunko Co., Ltd.) and the specimen was found to have an absorbance of 7.0 (transmittance: $10^{-5}$%) at 600 nm and 7.0 (transmittance: $10^{-5}$%) at 400 nm. In this case, the thickness of the specimen was equal to 3.67 mm.

The coating properties were examined by repeating the same procedures used in Example 1 except for using a positive photoresist (resist B) comprising a solid content, which comprised, for instance, an alkali-soluble resin mainly consisting of a cresol-formaldehyde novolak resin and a naphthoquinone diazide sulfonate type light-sensitive agent, as well as a solvent such as 2-heptanone, in place of the resist A prepared in Example 1. The results obtained are listed in Table 3. Moreover, the resulting photoresist was inspected for various properties, by the same methods used in Example 1, such as the resolution of the positive pattern, effective sensitivity, rate of remaining film, presence of scum (developing residues) and adhesion to the silicon wafer. The results obtained are summarized in Table 4.

The data shown in Tables 3 and 4 indicate that the resist B after the storage over a long period of time does not undergo any quality deterioration, since there was not observed any significant change in the coating properties, resolution, sensitivity, rate of remaining film, presence of scum and adhesion to silicon wafers.

TABLE 4

| Resist | Storage Time | Resolution (μm) | Sensitivity (msec) | Rate of Remaining Film (%) | Presence of Scum | Adhesion |
|---|---|---|---|---|---|---|
| Resist A | 0 hr. | 0.35 | 350 | 100 | None | Good |
| | 3 months | 0.35 | 350 | 100 | None | Good |
| Resist B | 0 hr. | 0.30 | 370 | 100 | None | Good |
| | 3 months | 0.30 | 370 | 100 | None | Good |

Comparative Example 1

The inner bag C was prepared from poly (tetrafluoroethylene) (PTFE). The inner bag D was prepared from a low density polyethylene (LDPE), which comprised 5.86% of a polymer having a density of 0.924, a melt index of 1.50 g/10min. and a weight-average molecular weight of not more than $1\times10^3$. These inner bags C and D each was accommodated in the same stainless steel external container used in Example 1. The same procedures used in Example 1 were repeated to determine the cleanness, rate of weight loss (%) and metal ion concentration. The results obtained are summarized in Tables 1 and 2.

As will be seen from the data listed in Tables 1 and 2, the PTFE inner bag C released a large number of impure fine particles into the content thereof and more specifically, the bag C showed a cleanness of 110 particles/ml for water, 265 particles/ml for the resist and 358 particles/ml for the resist after the storage over one month. In addition, the bag also released calcium and iron ions into the content thereof. Moreover, the LDPE inner bag D released a large number of impure fine particles into the content thereof and more specifically, the bag D showed a cleanness of 2575 particles/ml for water, 2656 particles/ml for the resist and 3290 particles/ml for the resist after the storage over one month. In addition, the bag also released calcium and iron ions into the content thereof.

On the other hand, as has been shown in Table 1, the rate of weight loss (%), with time, of ethyl cellosolve acetate stored in the PTFE inner bag C was very low and more specifically, it was found to be not more than 0.01% when it was stored at 23° C. for 6 months and not more than 0.01% when it was stored at 40° C. for 3 months. Contrary to this, the rate of weight loss (%), with time, of ethyl cellosolve acetate stored in the LDPE inner bag D was found to be 0.01% when it was stored at 23° C. for 6 months and 0.02% when it was stored at 40° C. for 3 months. In other words, the bag D was found to be permeable to the solvent.

As has been discussed above, these PTFE and LDPE inner bags released a large number or amount of particles and ions and would contaminate the photoresist. Therefore, they are not suitably used as containers for photoresist liquids.

Comparative Example 2

The same procedures used in Example 1 were repeated using a metal container (SUS304) and a glass bottle to determine the cleanness, absorbance, rate of weight changes and released metal ion concentration. The results obtained are listed in Tables 1 and 2.

The data listed in Table 1 indicate that the metal container released a large number of impure fine particles into the content thereof, more specifically, the metal container showed a cleanness of 273 particles/ml for water, 656 particles/ml for the resist A and 863 particles/ml for the resist A after the storage over one month and that the metal container released a large amount of iron and nickel ions into the content.

The data likewise indicate that the glass bottle released a large number of impure fine particles into the content thereof, more specifically, the glass bottle showed a cleanness of 1797 particles/ml for water, 341 particles/ml for the resist A and 506 particles/ml for the resist A after the storage over one month and that the glass bottle released a large amount of sodium ions into the content.

As has been discussed above, the metal container and the glass bottle released a large number or amount of impure fine particles and metal ions and this resulted in the contamination of the photoresist stored therein. Accordingly, these containers are not suitable as containers for liquid photoresists.

As has been described above in detail, the container for high purity chemicals according to the present invention does not release any significant amount of fine particles and/or metal ions into the content thereof during storage and transportation and can thus hold the quality of the high purity chemicals. Moreover, the internal container is not easily broken and is flexible and thus can easily be withdrawn from the external container after the practical use. The container permits easy and safe storage and discharge of the high purity chemical by exchanging the liquid-supply unit with an airtight cover.

What is claimed is:

1. A container for a high purity chemical, said container comprising:

a flexible internal container formed from a high purity polyolefinic resin and a gas-tight, self-supporting external container, which accommodates the internal container, wherein the internal and external containers are joined together having a space formed between these two containers close and open ensuring communication with the outside, a liquid-discharge pipe provided with a check valve connected to the pipe midway therein gas-tightly inserted into the internal container to the bottom thereof;

a connector connected to a pressure source fitted to the external container; and an airtightness-maintaining tool, holding the liquid-discharge pipe at an opening of the internal container, and engaging an opening of the external container via a screwing member that closes and opens so that the interior of the external container arbitrarily communicates with the outside.

2. The container for high purity chemicals as set forth in claim 1, wherein the liquid-discharge pipe is divided into an upper portion, supported by the airtightness-maintaining tool, the upper portion being provided with the check valve midway therein, and a lower portion inserted into the internal container having a cover for opening and closing, which engages the opening of the external container and opens and closes so that the interiors of the internal and external containers communicate with the outside, exchangeably with the action of the airtightness-maintaining tool.

3. The container for a high purity chemical as set forth in claim 2, wherein the liquid-discharge pipe and the airtightness-maintaining tool and the cover for opening and closing are formed from high purity polyolefinic resins similar to the resin of the internal container.

4. The container for a high purity chemical as set forth in claim 3, wherein the high purity polyolefinic resin is at least one member selected from the group consisting of polymers of olefins selected from ethylene, propylene, butene-1, 4-methyl-pentene-1, hexene-1 and octene-1; and copolymers of ethylene with olefins other than ethylene.

5. The container for a high purity chemical as set forth in claim 2, wherein the cover for opening and closing is formed from a high purity polyolefinic resin similar to the resin of the internal container.

6. The container for a high purity chemical as set forth in claim 5, wherein the high purity polyolefinic resin is at least one member selected from the group consisting of polymers of olefins selected from ethylene, propylene, butene-1, 4-methyl-pentene-1, hexene-1 and octene-1; and copolymers of ethylene with olefins other than ethylene.

7. The container for a high purity chemical as set forth in claim 1, wherein the high purity polyolefinic resin is at least one member selected from the group consisting of polymers of olefins selected from ethylene, propylene, butene-1, 4-methyl-pentene-1, hexene-1 and octene-1; and copolymers of ethylene with olefins other than ethylene.

* * * * *